United States Patent [19]

Schmidt

[11] 4,280,384

[45] Jul. 28, 1981

[54] APPARATUS FOR CUTTING STRIFS OF MATERIAL OF VARYING LENGTHS

[76] Inventor: Volker Schmidt, Rte. 7, Lexington, Ky. 40502

[21] Appl. No.: 14,296

[22] Filed: Feb. 23, 1979

[51] Int. Cl.[3] ..... B26D 7/06

[52] U.S. Cl. ..... 83/234; 83/250; 83/273

[58] Field of Search ..... 83/234, 273, 250

[56] References Cited

U.S. PATENT DOCUMENTS

| | | | |
|---|---|---|---|
| 2,720,261 | 10/1955 | Koch | 83/250 X |
| 2,973,706 | 3/1961 | Kingsley | 83/234 |
| 3,266,357 | 8/1966 | Littell | 83/273 X |
| 3,296,907 | 1/1967 | Edelman | 83/250 X |
| 3,512,439 | 5/1970 | Kallenberg et al. | 83/250 X |
| 3,664,220 | 5/1972 | Blair | 83/273 X |
| 3,701,300 | 10/1972 | Schmidt | 83/80 |

*Primary Examiner*—Donnald R. Schran
*Attorney, Agent, or Firm*—Frank C. Leach, Jr.

[57] ABSTRACT

A selected length of a strip of material is intermittently fed past a cutting position having cutting means. The cutting means is activated only after a selected number greater than one of the selected lengths of the strip of material has been intermittently fed past the cutting position. The selected number of the selected length of the strip is variable so as to cut the same number of the selected length of the strip each time or to cut a varying number of the selected length of the strip in a sequential pattern. The selected length, which is fed during each intermittent feeding, also is variable.

17 Claims, 13 Drawing Figures

APPARATUS FOR CUTTING STRIPS OF MATERIAL OF VARYING LENGTHS

In U.S. Pat. No. 3,701,300 to Volker Schmidt et al, there is shown a material cutting apparatus for cutting segments of a strip of material. Prior to cutting, the length of each segment of material can be selected within a specific range. Thus, in the aforesaid Schmidt et al patent, the length of the strip of material can be varied but there is cutting of the material after each selected length has been fed past the cutting position.

In the aforesaid Schmidt et al patent, the thickness of each segment of material to be cut is measured during the feed portion of the previous cycle to that in which the segment is cut. If the thickness of the segment is within a predetermined thickness range, a selector diverts the cut segment to one collector area while the selector diverts the cut segment to a different collector area if the segment is not within the predetermined thickness range.

The material cutting apparatus of the present invention is an improvement of the material cutting apparatus of the aforesaid Schmidt et al patent insofar as cutting of the material is concerned. The apparatus of the present invention is not necessarily concerned with measuring the thickness of the material being cut.

The apparatus of the present invention enables a relatively long length of material to be cut. The length of the strip to be cut can be varied as desired. Furthermore, the apparatus of the present invention contemplates cutting varying lengths in a sequential pattern.

The apparatus of the present invention utilizes the intermittent feeding of the material cutting apparatus of the aforesaid Schmidt et al patent. However, the apparatus of the present invention employs an arrangement in which the cutting means is not effective after each intermittent feeding as in the aforesaid Schmidt et al patent. Instead, the apparatus of the present invention utilizes a control arrangement for controlling activation of the cutting means so that the cutting means is only activated after a selected number of cycles of intermittent feeding of the strip of material past the cutting position has occurred.

U.S. Pat. No. 3,760,669 to Rosenthal et al discloses an apparatus in which a selected length of material is fed and then cut. The length of the fed material can be selected through changing the distance that a switch on a drum has to rotate prior to engaging a fixed finger to cause an electronic control circuit to be activated. Thus, the apparatus of the aforesaid Rosenthal et al patent requires electronic control means to have the cutting means activated and has a continuous feed of a selected length.

The apparatus of the present invention does not require any electronic control means. Thus, no possibility of failure due to an electrical component can occur with the apparatus of the present invention. This eliminates any need for a skilled electronics technician to repair.

Furthermore, the apparatus of the present invention enables changing of the total length of each strip of material to be cut to be easily accomplished. Additionally, a sequential pattern of varying total lengths can be cut with the apparatus of the present invention.

An object of this invention is to provide an improved material cutting apparatus.

Another object of this invention is to provide a material cutting apparatus for cutting variable selected lengths of a strip of material.

A further object of this invention is to provide a material cutting apparatus for cutting different selected lengths from a strip of material in a sequential pattern.

Other objects of this invention will be readily perceived from the following description, claims, and drawings.

This invention relates to an improvement in an apparatus for cutting a strip of material into segments with the apparatus including feed means to intermittently feed a selected length of the strip of material past a cutting position and cutting means adapted to cut the fed material at the cutting position after each intermittent feeding of the fed material by the feed means. The improvement comprises means to activate the cutting means to cut the fed material only after a selected number, greater than one, of the selected length of the strip of material has been fed past the cutting position by the feed means.

This invention also relates to an improvement in an apparatus for cutting a strip of material into segments in which the apparatus includes feed means to feed a selected length of the strip of material past a cutting position during a first portion of each cycle of operation and cutting means adapted to cut the fed material at the cutting position during a second portion of each cycle of operation. The improvement comprises means to control the cutting means to enable the cutting means to cut the fed material only after a selected number, greater than one, of the selected length of the strip of material has been fed past the cutting position by the feed means.

The attached drawings illustrate a preferred embodiment of the invention, in which.

Figure 1:
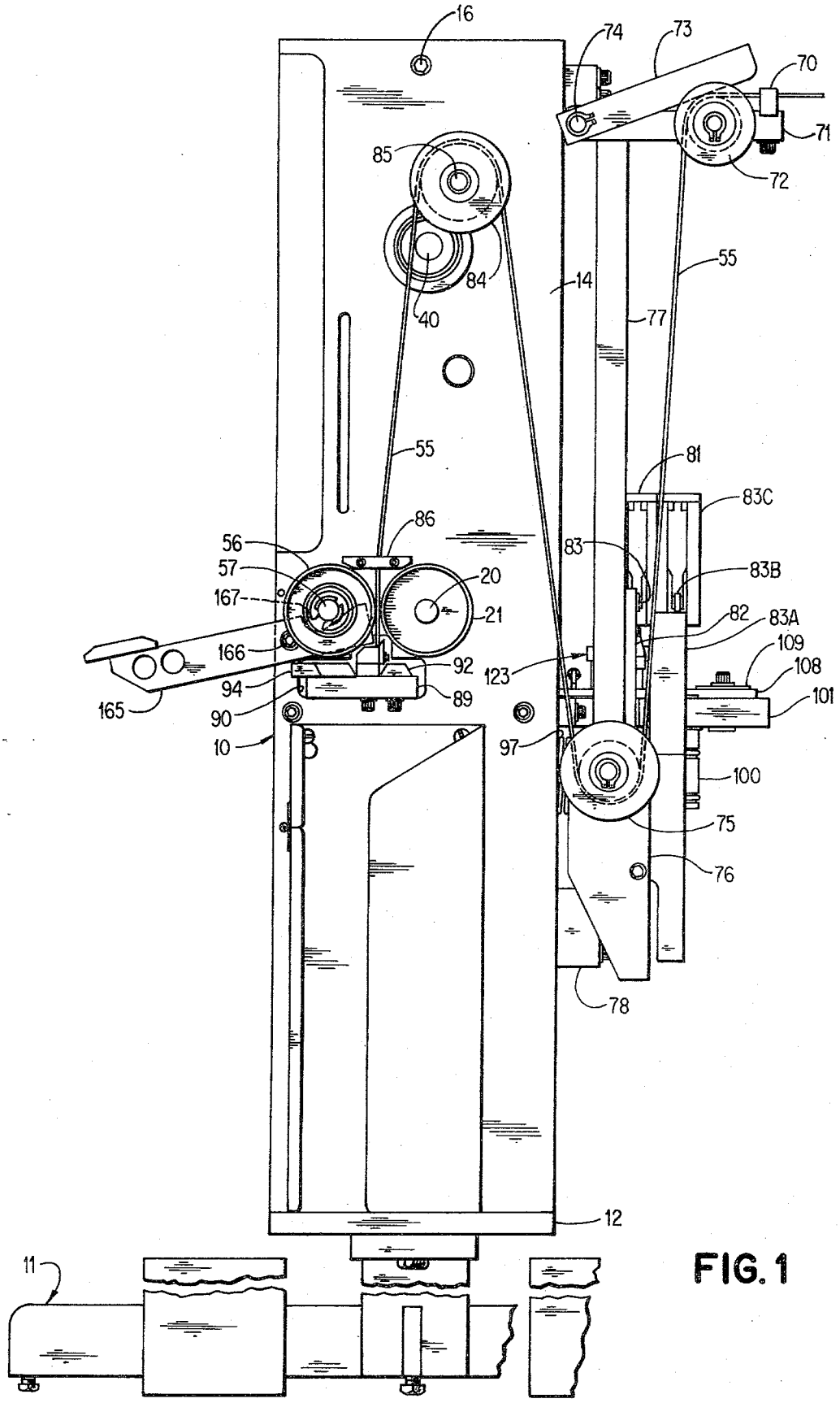
FIG. 1 is a front elevational view of the apparatus of the present invention.

Referring to the drawings and particularly FIG. 1, there is shown a cutting apparatus of the present invention including a frame 10 supported on a stand 11. The frame 10 has a base 12, which is supported by the stand 11, and a pair of upstanding supports 14 (see FIG. 3) and 15, which are spaced from each other and substantially parallel to each other.

The supports 14 and 15 have a connector 16 extending therebetween adjacent their upper ends. A cover (not shown) is connected to the upper ends of the supports 14 and 15.

A shaft 20 is rotatably supported by the supports 14 and 15, which extend upwardly from the base 12 (see FIG. 1), and extends beyond each side thereof. A knurled roller 21, which is preferably formed of metal, is fixed to the shaft 20 for rotation therewith. Thus, whenever the shaft 20 is rotated, the knurled roller 21 is rotated.

The shaft 20 is rotatably supported in the support 14 by a bearing housing 22 (see FIG. 10) through which the shaft 20 extends. The shaft 20 is rotatably supported in the support 15 by a bearing housing 23 through which the shaft 20 extends.

A gear housing 24 is mounted on the shaft 20 adjacent the bearing housing 23 and has the shaft 20 extending therethrough. The gear housing 24 is held in position adjacent the bearing housing 23 by a collar 25, which is fixed to the end of the shaft 20.

Figure 2:
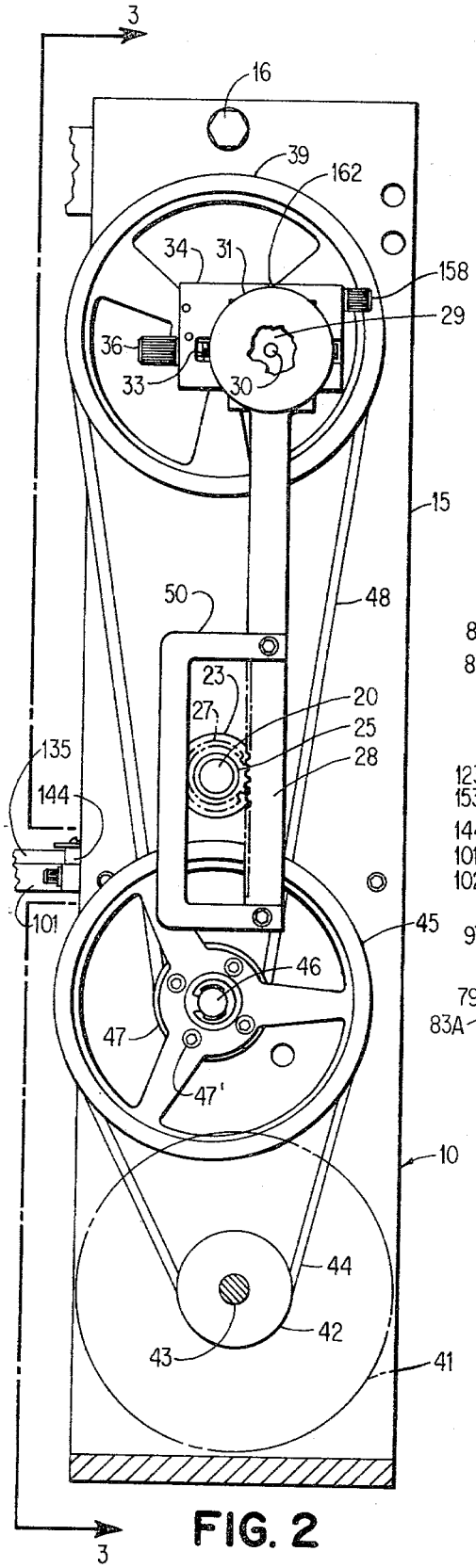
FIG. 2 is a rear elevational view of the apparatus of the present invention.

Each of the bearing housings 22 and 23, which are secured to the supports 14 and 15, respectively, and the gear housing 24 has a one direction clutch 26 disposed therein whereby the shaft 20 can be rotated only in one direction even though a gear 27 on the gear housing 24 is driven in opposite directions by a cooperating rack 28 (see FIG. 2). One suitable example of the one direction clutches 26 (see FIG. 10), which rotatably mount the shaft 20, is sold by Torrington Manufacturing Company, Torrington, Connecticut as Model RCB-081214.

Figure 11:
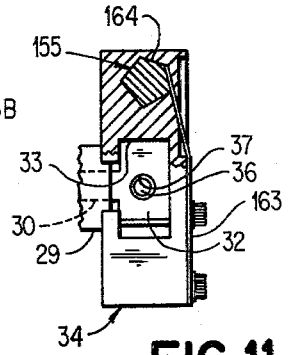
FIG. 11 is an end elevational view, partly in section, of the mechanism of FIG. 9.

The upper end of the rack 28 (see FIG. 2) is secured to a bearing 29 by a step screw 30 and a knurled lock nut 31. The step screw 30 has its head 32 (see FIG. 11) sliding in a groove 33 in a block 34. An adjusting screw 36 extends through the block 34 and is threadedly connected to a tapped hole 37 in the head 32 of the step screw 30.

Figure 4:
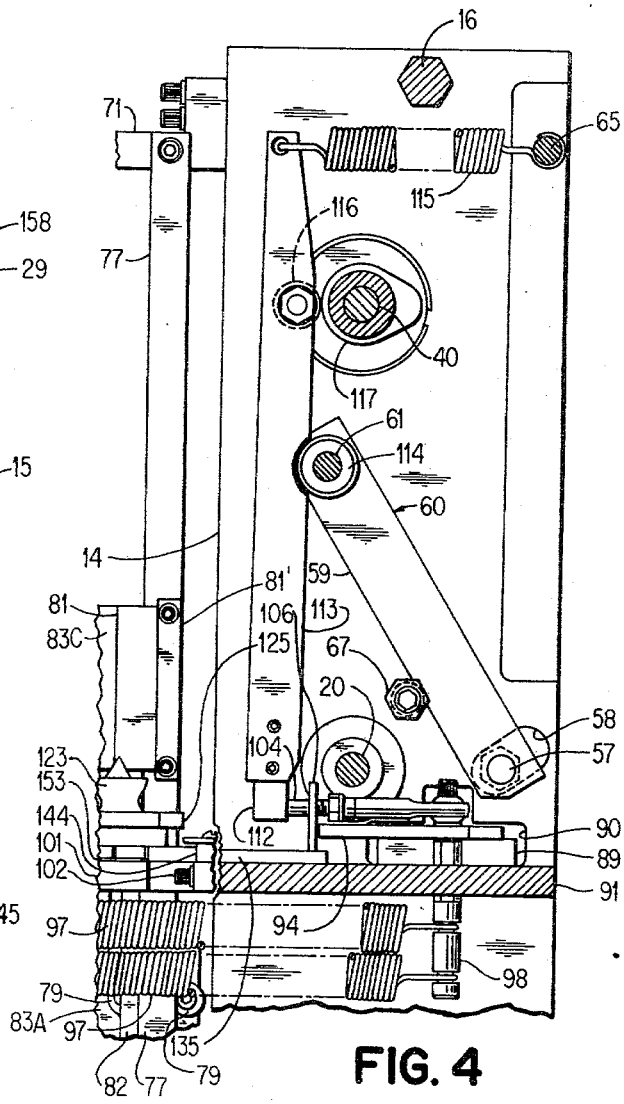
FIG. 4 is an elevational view, partly in section, looking toward the front of the apparatus of the present invention and taken substantially along line 4—4 of FIG. 3 and line 4—4 of FIG. 6.
Figure 3:
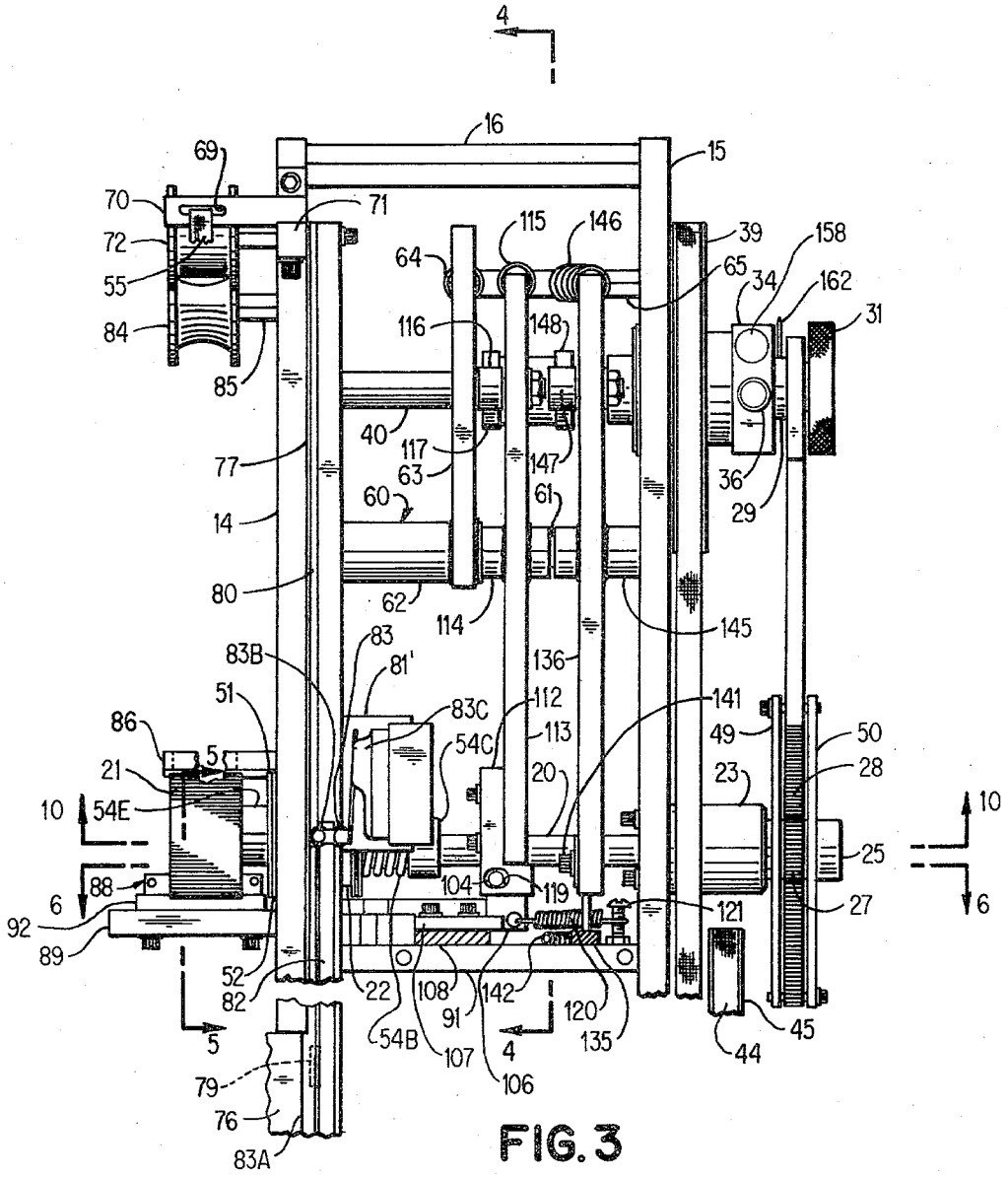
FIG. 3 is a side elevational view of a portion of the apparatus of FIG. 2 and taken along line 3—3 of FIG. 2.

The block 34 is fixed to a pulley 39 (see FIG. 2), which is supported on one end of a shaft 40 (see FIGS. 3 and 4). The shaft 40 is rotatably mounted in the supports 14 and 15 (see FIG. 3).

Accordingly, when the pulley 39 is rotated, the rack 28 is moved in an upward or downward direction with the amount of movement of the rack 28 in each direction being determined by the position of the step screw 30 (see FIG. 2) relative to the rotational axis of the pulley 39. Thus, by moving the step screw 30, which has its head 32 (see FIG. 11) slidable in the groove 33 in the block 34, in the block 34 further from the axis of rotation of the pulley 39 (see FIG. 2), the movement of the rack 28 for each revolution of the pulley 39 in each direction is increased. Similarly, moving the step screw 30 closer to the axis of rotation of the pulley 39 decreases the movement of the rack 28 for each revolution of the pulley 39.

The pulley 39 is driven from a motor 41 (see FIG. 2), which is supported on a portion of the base 12 of the frame 10 extending beyond the support 15 and remote from the support 14 (see FIG. 3). The motor 41 (see FIG. 2) has a pulley 42 on its shaft 43 connected by a belt 44 to a pulley 45, which is rotatably mounted on a stud 46 fixed to the support 15 of the frame 10. The pulley 45 has a pulley 47 rotatable therewith by being secured thereto by screws 47', for example. A belt 48 connects the pulley 47 to the pulley 39 whereby the pulley 39 rotates due to the motor 41 being activated.

To maintain the rack 28 in engagement with the gear 27 on the gear housing 24 (see FIG. 10), a pair of U-shaped bars 49 (see FIG. 3) and 50 is secured to the opposite sides of the rack 28. Each of the bars 49 and 50 has one end secured to the rack 28 adjacent the lower end of the rack 28 and the other end secured to the rack 28 intermediate its ends. The inner bar 49 passes between the gear 27 and the end of the bearing housing 23 while the outer bar 50 bears against the other side of the gear 27. Accordingly, the rack 28 is maintained centered with respect to the gear 27.

Because of the one direction clutches 26 (see FIG. 10), the shaft 20 is rotated only when the rack 28 (see FIG. 2) is moved downwardly by the rotation of the pulley 39. Accordingly, the shaft 20 is rotated only during 180° of each revolution of the pulley 39.

When the knurled roller 21 (see FIG. 1) is rotated by the downward movement of the rack 28 (see FIG. 2), there is no overtravel of the knurled roller 21 (see FIG. 1) when the downward movement of the rack 28 (see FIG. 2) is stopped. When the knurled roller 21 (see FIG. 1) rotates, a metallic disc 51 (see FIG. 10), which rotates with the knurled roller 21 (see FIG. 1), rubs against a felt washer 52 (see FIG. 10), which is disposed between the disc 51 and the support 14 and does not rotate with the disc 51 because of engagement with the support 14, and a metallic disc 53, which rotates with the knurled roller 21 (see FIG. 1), rubs against a felt washer 54 (see FIG. 10), which is disposed between the disc 53 and a metallic disc 54A.

A spring 54B, which is disposed between the metallic disc 53 and a collar 54C, which is fixed to the shaft 20, continuously urges the metallic disc 53 against the felt washer 54 and the felt washer 54 against the metallic disc 54A, which bears against the end of the bearing housing 22 and does not rotate. The felt washer 54 does not rotate with the disc 53 because of engagement with the fixed disc 54A. When the knurled roller 21 (see FIG. 1) ceases to be rotated, the disc 51 (see FIG. 10) and the felt washer 52 and the disc 53, the felt washer 54, and the disc 54A cooperate to produce the braking effect to prevent any overtravel of the knurled roller 21 (see FIG. 1).

Figure 10:
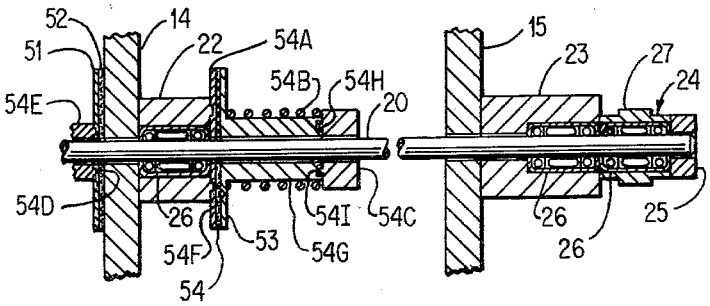
FIG. 10 is a sectional view showing the support arrangement for the driven roller of the feed mechanism of the apparatus of the present invention and taken along line 10—10 of FIG. 3.

The disc 51 (see FIG. 10) is rotated with the knurled roller 21 (see FIG. 1) due to two diametrically disposed pins 54D (see FIG. 10) on a reduced portion 54E of the knurled roller 21 (see FIG. 1) being disposed in diametrically disposed cooperating openings in the disc 51 (see FIG. 10). The disc 54A is secured to the bearing housing 22 to prevent rotation of the disc 54A through a pair of diametrically disposed pins 54F being disposed in diametrically disposed cooperating openings in the disc 54A. The disc 53 rotates with the shaft 20 through having a hub 54G formed with a pair of diametrically disposed longitudinal slots 54H to receive a pair of diametrically disposed pins 54I extending from the collar 54C towards the disc 53. Accordingly, because of the longitudinal slots 54H, the disc 53 can move longitudinally along the axis of the shaft 20 because of the spring 54B until the felt washer 54 is urged against the metallic disc 54A.

The rotation of the shaft 20 results in a strip 55 (see FIG. 1) of material being advanced due to the knurled roller 21 cooperating with a roller 56. The knurled roller 21 is rotated the same amount as the shaft 20.

Accordingly, the amount of rotation of the knurled roller 21 during each revolution of the pulley 39 (see FIG. 2) is determined by the downward movement of the rack 28. Therefore, by adjusting the position of the step screw 30 in the block 34 through the adjusting screw 36 moving the head 32 (see FIG. 11) of the step screw 30 in the groove 33, the amount of feed of the strip 55 (see FIG. 1) of material during each revolution of the pulley 39 (see FIG. 2) can be selected to give a desired length of the strip 55 (see FIG. 1) of material that is to be advanced during each revolution.

The roller 56, which is any suitable material such as steel or nylon, for example, is rotatably mounted on a stud 57, which extends through an enlarged opening 58 (see FIG. 4) in the support 14 of the frame 10 and has its other end fixed to the lower end of an arm 59 of a lever 60. The lever 60 is pivotally mounted on a rod 61, which extends between the supports 14 and 15 (see FIG. 3) by a hub 62 surrounding the rod 61. The lever 60 has an upwardly extending arm 63, which has a spring 64 secured thereto adjacent its free end, extending from the hub 62 in addition to the downwardly extending arm 59 (see FIG. 4) and at the opposite longitudinal end of the hub 62 (see FIG. 3) to the arm 59 (see FIG. 4). The spring 64 has its other end secured to a stud 65, which is fixed to the support 15 (see FIG. 3).

The spring 64 continuously urges the arm 59 (see FIG. 4) of the lever 60 against a stop 67 on the support 14. In this position of the lever 60, there is a very minute space between the roller 56 (see FIG. 1) and the knurled roller 21 to prevent any engagement between the rollers 21 and 56 if there is no material therebetween. This prevents any damage to the roller 56 by the knurled roller 21.

However, because of the spring 64 (see FIG. 3) continuously urging the arm 59 (see FIG. 4) against the stop 67, the roller 56 (see FIG. 1) is positioned so that it can cooperate with the knurled roller 21 whereby the knurled roller 21 can feed the strip 55 of material therebetween. The strip 55 of material is fed through an opening 69 (see FIG. 3) in a lead-in guide 70, which is supported on the end of an arm 71 (see FIG. 1) fixed to the support 14.

The strip 55 of material is fed over a guide roller 72, which is rotatably mounted on the arm 71. A drag arm 73, which is pivotally mounted on a pin 74 extending from the arm 71, bears against the strip 55 of material to maintain a drag on the strip 55 of material.

The strip 55 of material passes downwardly from the roller 72 around a roller 75, which is rotatably mounted on a slidably mounted block 76. The block 76 is mounted for sliding movement on a vertically disposed bar 77, which has its upper end fixed to the back of the arm 71 and its lower end secured to a block 78 fixed to the support 14, through having rollers 79 (see FIGS. 3 and 4) slide in longitudinal grooves 80 (see FIG. 3) in opposite sides of the bar 77.

The roller 75 (see FIG. 1) and the block 76 move upwardly only when the strip 55 of material is prevented from being fed from a supply source. Whenever the roller 75 and the block 76 move upwardly a predetermined distance because of the strip 55 of material being prevented from being fed from the supply source, a switch 81, which is mounted on the bar 77 by a block 81' (see FIGS. 3 and 4), is opened because a bar 82 (see FIGS. 1 and 3) on the block 76 ceases to engage a roller 83 (see FIG. 1) on a resiliently biased arm of the switch 81. When the switch 81 is opened, the motor 41 (see FIG. 2) is turned off whereby feeding of the strip 55 (see FIG. 1) of material between the rollers 21 and 56 is stopped due to the rack 28 (see FIG. 2) being prevented from moving because of the inactivation of the motor 41.

The motor 41 is not turned on until a bar 83A, which is mounted on the block 76, is returned to the position of FIG. 1 in which the upper end of the bar 83A is disposed beneath a roller 83B on a resiliently biased arm of a switch 83C, which is supported by the switch 81. Thus, after the motor 41 (see FIG. 2) is de-energized because of the roller 75 (see FIG. 1) moving upwardly a predetermined distance, the motor 41 (see FIG. 2) is not energized until the roller 75 returns to its lowermost position, which is shown in FIG. 1.

The strip 55 (see FIG. 1) of material passes upwardly from the roller 75 over a guide roller 84, which is rotatably mounted on a stud 85 fixed to the support 14 and extending therefrom. From the roller 84, the strip 55 of material passes through an opening in a feed-in guide 86, which is supported on the support 14. The opening in the feed-in guide 86 is vertically aligned with the space between the rollers 21 and 56. Thus, the strip 55 of material is vertical when it passes between the rollers 21 and 56.

Then, the strip 55 of material passes through an opening 87 (see FIG. 5) in a guide 88, which is supported on a plate 89. The plate 89 extends through an opening 90 (see FIG. 1) in the support 14 and is fixed to a horizontally disposed plate 91 (see FIGS. 3 and 6), which extends between the supports 14 and 15 and is connected thereto.

The plate 89 supports a knife or cutting blade 92 (see FIG. 5) on its upper surface. The knife or cutting blade 92 cooperates with a movable knife or cutting blade 93 to cut the strip 55 of material when the movable knife or cutting blade 93 is moved horizontally relative to the stationary knife or cutting blade 92.

Figure 5:
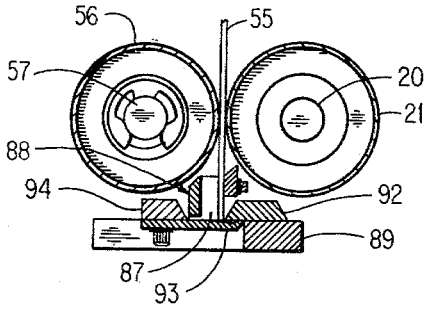
FIG. 5 is a sectional view, partly in elevation, showing the relationship between the feed roll and the guide means of the present invention and taken along line 5—5 of FIG. 3 with the cutting blade being in its cutting position.
Figure 6:
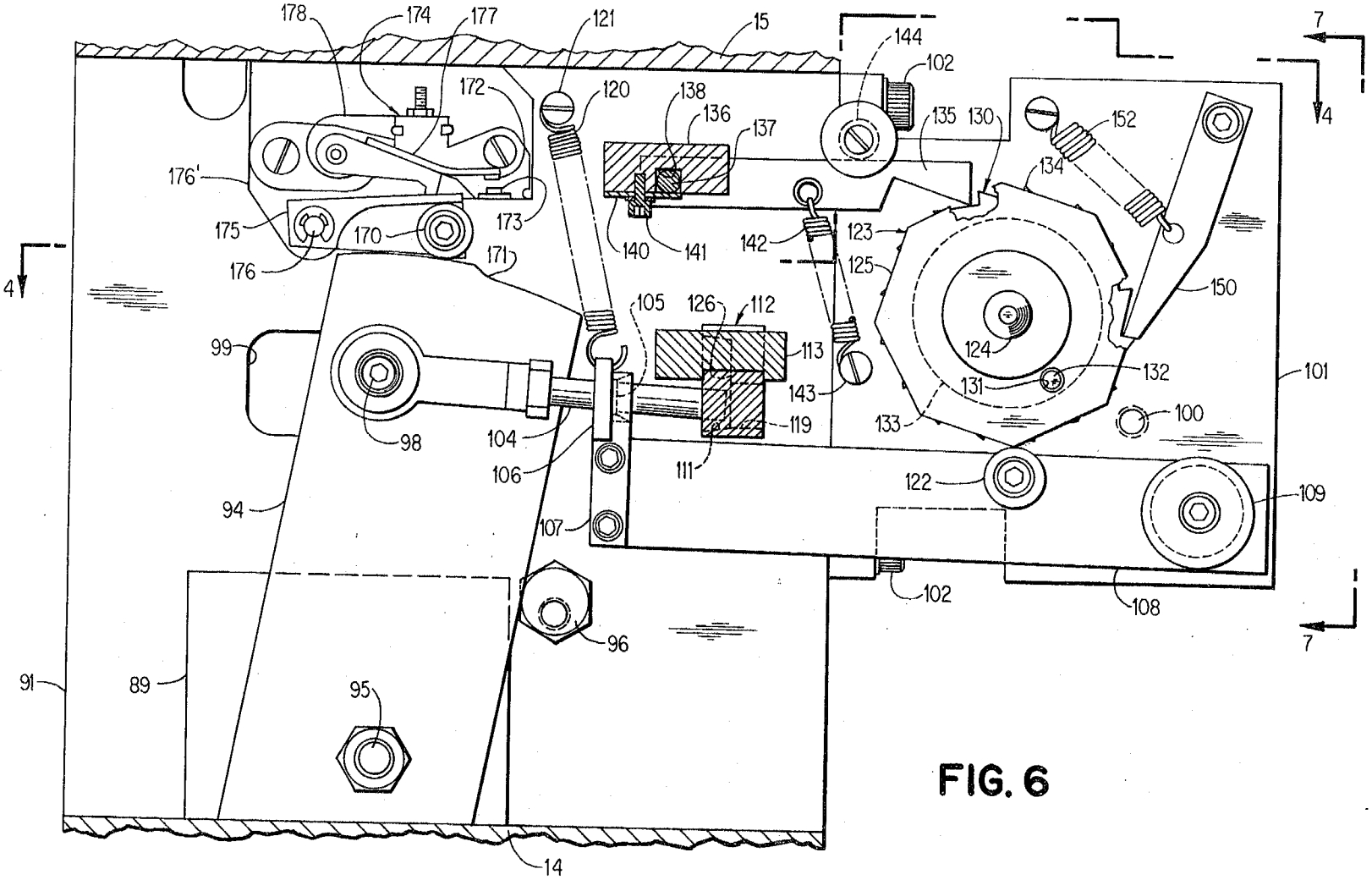
FIG. 6 is a top plan view, partly in section, showing the relationship for activating the cutting means only after a selected number of cycles and taken along line 6—6 of FIG. 3.

The movable knife or cutting blade 93 is fixed to an arm 94, which extends through the opening 90 (see FIG. 1) in the support 14 and is pivotally mounted on the plate 89 by a pivot pin 95 (see FIG. 6). Accordingly, when the arm 94 is pivoted about the pivot pin 95, cutting of the strip 55 (see FIG. 5) of material occurs.

As shown in FIG. 5, the knife or cutting blade 93 has its end, which cooperates with the stationary cutting blade 92 to cut the strip 55 of material, extending or projecting slightly (about 0.005 inch) above the remainder of the upper surface of the cutting blade 93. The guide 88 has the central portion of its bottom surface undercut slightly (about 0.005 inch). These are exaggerated in FIG. 5.

Accordingly, the projecting end of the cutting blade 93 has only one side engaged by the guide 88 at one side of the guide 88. When the cutting blade 93 is pivoted with the arm 94 about the pivot pin 95 (see FIG. 6) to move the cutting blade 93 (see FIG. 5) toward the stationary cutting blade 92, a scissor action occurs as the projecting end of the cutting blade 93 moves along the bottom of the stationary cutting blade 92.

Figure 7:
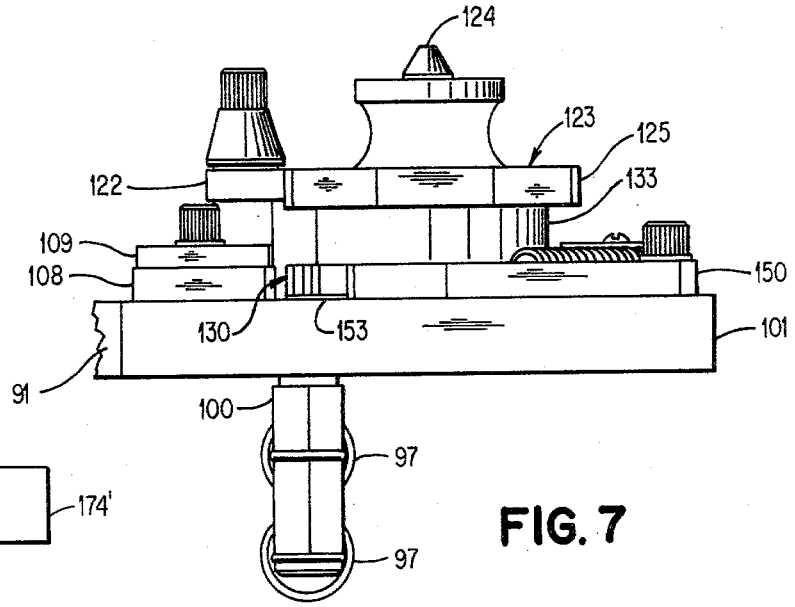
FIG. 7 is an end elevational view of a portion of the apparatus of the present invention and taken along line 7—7 of FIG. 6.

The arm 94 is biased against a stop 96 (see FIG. 6), which is supported on the plate 91, by a pair of springs 97 (see FIG. 7). One end of each of the springs 97 is secured to a stud 98 (see FIGS. 4 and 6), which is carried by the arm 94 and extends downwardly through an opening 99 (see FIG. 6) in the plate 91. Each of the springs 97 has its other end secured to a stud 100 (see FIG. 7), which is carried by a plate 101. The plate 101 is secured to the plate 91 by Allen screws 102 (see FIG. 6).

The arm 94 has a finger 104 pivotally connected thereto through being pivotally connected to the stud 98. The finger 104 extends through an opening 105 in an L-shaped block 106, which is fixed to a block 107 mounted at one end of an arm 108. The arm 108 is pivotally mounted by a step bushing 109 on the plate 101 and adjacent the opposite end of the arm 108 from the end having the block 107.

Figure 8:
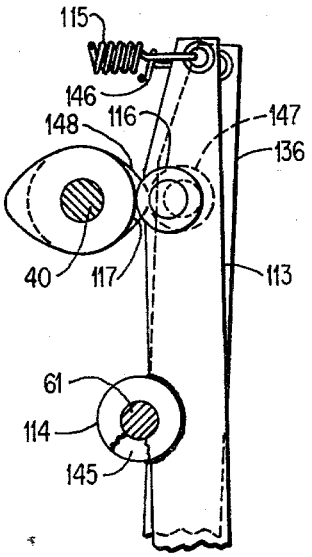
FIG. 8 is a fragmentary elevational view, partly in section, showing the relationship of a cam with certain arms having cam followers thereon.

The end of the finger 104 is disposed within a recess 111 in an L-shaped block 112, which is carried at the lower end of an arm 113. The arm 113 is pivotally mounted on the rod 61 (see FIG. 4) by a hub 114 surrounding the rod 61. A spring 115, which has one end connected to the upper end of the arm 113 and its other end secured to the stud 65, continuously biases the arm 113 so that a roller 116 (see FIGS. 3, 4, and 8), which is mounted between the upper end of the arm 113 and the hub 114 of the arm 113, engages a surface of a cam 117, which is secured to the shaft 40. Thus, the roller 116 functions as a cam follower.

Accordingly, during each revolution of the pulley 39 (see FIG. 2), the cam 117 (see FIGS. 4 and 8) cooperates with the roller 116 to move the arm 113 against the force of the spring 115. As a result, the block 112 moves to the left in FIG. 6 to the position shown for the block 112 so that the end of the finger 104 enters a passage 119 in the block 112 when the arm 108 is in the position of FIG. 6.

The arm 108 has a spring 120, which has one end secured to the block 106 and its other end connected to a screw 121 on the plate 91, continuously urging the arm 108 clockwise as viewed in FIG. 6. A roller 122, which is mounted on the arm 108 and functions as a cam follower, cooperates with the surface of a cam 123, which is rotatably mounted on an upstanding stud 124 on the plate 101. When a low dwell on profile 125 of the cam 123 is engaged by the roller 122, the spring 120 pivots the arm 108 clockwise from the position of FIG. 6. As a result, the finger 104 is moved slightly so that it engages bottom wall 126 of the recess 111 in the block 112.

Accordingly, when the finger 104 is disposed to engage the bottom wall 126 of the recess 111 in the block 112 due to the roller 122 on the arm 108 engaging a low dwell on the profile 125 of the cam 123, the movement of the arm 113 against the force of the spring 115 (see FIG. 4) by a high dwell on the cam 117 cooperating with the roller 116 on the arm 113 results in the arm 94 (see FIG. 6) being pivoted counterclockwise (as viewed in FIG. 6) about the pin 95 because of the arm 113 moving to the left (as viewed in FIG. 6). This moves the cutting blade 93 into cooperation with the stationary cutting blade 92, as shown in FIG. 5, to cut the strip 55 of material. The profile of the cam 117 (see FIGS. 4 and 8) is designed so that the spring 115 becomes effective as soon as cutting of the strip 55 (see FIG. 5) of material is completed to retract the cutting blade 93 from cooperation with the cutting blade 92 to its inactive position.

Accordingly, the cutting of the strip 55 of material is coordinated with feeding of the strip 55 of material by driving the knurled roller 21. The cutting of the strip 55 of material does not occur until after feeding of the strip 55 of material has been completed. Since feeding of the strip 55 of material ceases when downward movement of the rack 28 (see FIG. 2) stops, the cutting of the strip 55 (see FIG. 1) of material occurs during upward movement of the rack 28 (see FIG. 2).

The cam 123 (see FIG. 6) is positioned on the stud 124 and aligned with respect to a ratchet 130 through a hole 131 in the cam 123 receiving an upstanding pin 132 on a reduced support portion 133 of the ratchet 130. The circumference of the ratchet 130, which is rotatably mounted on the stud 124, has sixteen equally angularly spaced teeth 134 thereon.

The profile 125 of the cam 123 has one or more low dwells thereon with the maximum number of the low dwells being equal to one-half the number of the teeth 134 on the ratchet 130. Thus, with the ratchet 130 having sixteen of the teeth 134, the maximum number of the low dwells is eight so that the number of the low dwells on the profile 125 of the cam 123 can vary from one to eight when there are sixteen of the teeth 134 on the ratchet 130. Each of the low dwells on the profile 125 of the cam 123 is aligned with one of the teeth 134.

A driving pawl 135, which is attached to a pivotally mounted arm 136, engages one of the teeth 134 on the ratchet 130 to rotate the ratchet $22\frac{1}{2}°$ each time that the driving pawl 135 is moved by the arm 136 since there are sixteen of the teeth 134 spaced $22\frac{1}{2}°$ from each other. The arm 136 causes this movement of the driving pawl 135 each time that there is intermittent feeding of the strip 55 (see FIG. 1) of material.

Thus, when the cam 123 (see FIG. 6) has only one of the low dwells on the profile 125, there is cutting only after sixteen intermittent feedings of the strip 55 (see FIG. 1) of material prior to cutting. This will cause the same length of the strip 55 of material to be cut each time. Similarly, when the profile 125 (see FIG. 6) of the cam 123 has a plurality of equally angularly spaced low dwells, the total length of the strip 55 (see FIG. 1) of material to be cut each time is the same. For example, when there are two of the low dwells equally angularly spaced on the profile 125 (see FIG. 6) of the cam 123, the total length of the strip 55 (see FIG. 1) of material to be cut each time is the same and will occur after eight intermittent feedings of the strip 55 of material prior to cutting of the strip 55 of material.

When there are eight of the low dwells on the profile 125 (see FIG. 6) of the cam 123, there are two intermittent feedings of the strip 55 (see FIG. 1) of material prior to each cutting of the strip 55 of material. Thus, with the low dwells on the profile 125 (see FIG. 6) of the cam 123 equally angularly spaced from each other, there can be any number from one to eight low dwells on the cam 123. Therefore, a plurality of the cams 123 is provided with each having a different number of the low dwells thereon. This enables a selection of the number of intermittent feedings of the strip 55 (see FIG. 1) of material past the cutting position prior to cutting.

Figure 12:
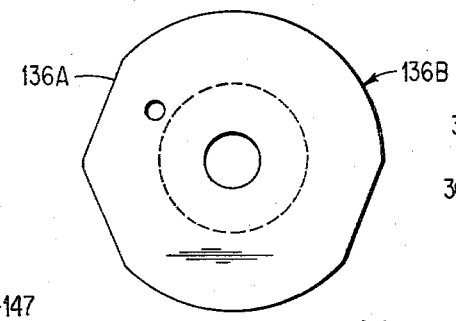
FIG. 12 is a top plan view of a cam utilized to cut variable lengths of material in a sequential pattern.

Furthermore, if desired, the profile 125 (see FIG. 6) of the cam 123 could be replaced by a profile 136A (see FIG. 12) of a cam 136B formed to have the low dwells not equally angularly spaced from each other. For example, as shown in FIG. 12, the profile 136A of the cam 136B has three low dwells with the center of two of the low dwells spaced 45° from each other and the center of one of the two dwells spaced 135° from the third of the three low dwells. This would result in two intermittent feedings of the strip 55 (see FIG. 1) of material prior to the first cutting, six intermittent feedings of the strip 55 of material prior to the second cutting, and eight intermittent feedings of the strip 55 of material prior to the third cutting. Thus, variable lengths of the strip 55 of material would be cut in a sequential pattern during each revolution of the cam 136B (see FIG. 12).

Each of the cams 123 (see FIG. 6), which has the low dwells equally angularly spaced on the profile 125 thereof, has a number thereon to correspond to the number of intermittent feedings of the strip 55 (see FIG. 1) of material that will occur. Thus, when the cam 123 (see FIG. 6) has only one low dwell thereon, it has the number "16" thereon to indicate that sixteen intermittent feedings of the strip 55 (see FIG. 1) of material must occur prior to cutting.

The driving pawl 135 (see FIG. 6) is secured to the arm 136 through a pin 137, which is mounted in a longitudinal groove 138 of square cross section in the lower end of the arm 136, being disposed within a hole in the driving pawl 135. The diameter of the hole in the driving pawl 135 is slightly larger than the diameter of the pin 137. The pin 137 is retained within the groove 138 by a flat washer 140 overlapping the groove 138 to bear against the pin 137. The washer 140 is retained in position by an Allen screw 141 extending into the arm 136 adjacent the groove 138.

Even though the driving pawl 135 has a loose fit with the pin 137, a spring 142 maintains the driving pawl 135 in engagement with the circumference of the ratchet 130. The spring 142 has one end secured to the driving pawl 135 intermediate its ends and the other end connected to a screw 143 on the plate 101. A plastic stop 144 on the plate 101 limits the movement of the driving pawl 135 as it rides over the teeth 134 of the ratchet 130.

The arm 136 causes advancement of the pawl 135 during each intermittent feeding of the strip 55 (see FIG. 1) of the material to cause rotation of the ratchet 130 (see FIG. 6). The arm 136 is pivotally mounted on the rod 61 (see FIG. 8) by a hub 145 (see FIGS. 3 and 8) surrounding the rod 61.

A spring 146, which has one end connected to the upper end of the arm 136 and its other end secured to the stud 65, continuously biases the arm 136 so that a roller 147, which is mounted between the upper end of the arm 136 and the hub 145 of the arm 136, engages the surface of a cam 148, which is secured to the shaft 40. Thus, the roller 147 functions as a cam follower.

Accordingly, during each revolution of the pulley 39 (see FIG. 2), the cam 148 (see FIG. 8) cooperates with the roller 147 to move the arm 136 against the force of the spring 146. When this occurs, the driving pawl 135 is retracted to the left in FIG. 6 to ride over another of the teeth 134 on the ratchet 130. Then, when the arm 136 returns to the right in FIG. 6, the driving pawl 135 is moved by the spring 142 into engagement with another of the teeth 134 on the ratchet 130 to advance the ratchet 130 22½° clockwise.

If this rotation of the ratchet 130 causes one of the low dwells on the cam 123 to be rotated into engagement with the roller 122 on the arm 108, then the spring 120 pivots the arm 108 clockwise to position the finger 104 for engagement by the bottom wall 126 of the recess 111 in the block 112 on the arm 113. Thus, after the intermittent feeding of the strip 55 (see FIG. 1) of material has been completed during the first 180° of rotation of the pulley 39 (see FIG. 2), the movement of the arm 113 (see FIG. 6) to the left in FIG. 6 causes the arm 94 to pivot counterclockwise about the pin 95 whereby the cutting blade 93 (see FIG. 5) moves relative to the fixed cutting blade 92 to cut the strip 55 of material.

If no low dwell on the profile 125 (see FIG. 6) of the cam 123 is disposed to engage the roller 122 after rotation of the ratchet 130, the arm 108 remains in the position of FIG. 6. As a result, when the arm 113 moves to the left during the second half of the cycle of operation, the finger 104 enters the passage 119 in the block 112 so that the arm 93 is not moved by movement of the arm 113.

The teeth 134 of the ratchet 130 cooperate with a locking pawl 150, which is pivotally mounted on the plate 101, to prevent any counterclockwise rotation of the ratchet 130. The locking pawl 150 is urged into engagement with one of the ratchet teeth 134 by a spring 152.

The locking pawl 150 holds the ratchet 130 against counterclockwise rotation after the ratchet 130 has been advanced by the driving pawl 135. Felt washers 153 (see FIG. 7), which are disposed between the plate 101 and the ratchet 130, prevent any counterclockwise rotation after advancement of the ratchet 130 by the driving pawl 135 (see FIG. 6) beyond the position in which the locking pawl 150 is effective.

Figure 9:
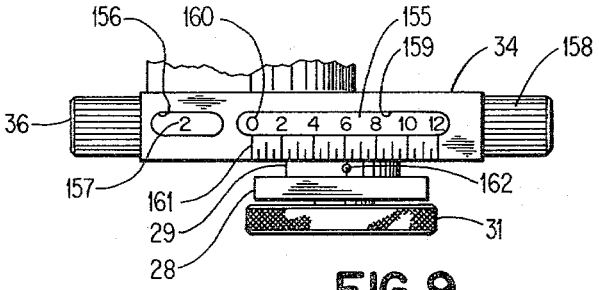
FIG. 9 is a top plan view of a mechanism to adjust the amount of feed of the strip of material during each cycle of operation and to select the total length of material to be cut during each cutting by the cutting means.

The block 34 (see FIG. 9) has a cylindrical shaped scale 155 rotatably mounted therein. The top of the block 34 has a first elongated opening 156 through which a number 157 on the scale 155 can be viewed. The number 157 on the scale 155 can be "2," "4," "8," or "16," for example, and corresponds to the number on the cam 123. Thus, the scale 155 is rotated by an adjusting screw 158, which is integral with the scale 155, until the number 157 in the first opening 156 corresponds to the cam 123 being utilized.

The top of the block 34 has a second elongated opening 159, which is substantially longer than the first opening 156, to enable viewing of another portion of the scale 155 having a plurality of numbers 160 thereon. Each of the numbers 160 on the scale 155 varies from zero to a multiple of the number 157 on the scale 155. The numbers 160 align with indicia 161 on the top of the block 34 and to one side of the opening 159.

The bearing 29 has a pointer or marker 162 thereon for cooperation with the indicia 161 on the block 34 so that the operator can select the exact length of the strip 55 (see FIG. 1) of material that is fed prior to cutting. The movement of the pointer 162 (see FIG. 9) relative to the indicia 161 on the block 34 is accomplished through movement of the adjusting screw 36.

Accordingly, the setting by the adjusting screw 36 determines the amount of feed of the strip 55 (see FIG. 1) of material during each revolution of the pulley 39 (see FIG. 2). This is because the movement of the pointer 162 is a result of changing the position of the step screw 30 relative to the axis of rotation of the pulley 39 to vary the amount of feed during each revolution of the pulley 39. The total length indicated by the pointer 162 aligned with the number 160 (see FIG. 9) on the scale 155 divided by the number 157 viewable in the first opening 156 in the block 34 is the selected length of the strip 55 (see FIG. 1) of material fed during each intermittent feeding, i.e., during each revolution of the pulley 39 (see FIG. 2).

Accordingly, through selecting the cam 123 (see FIG. 6) with the profile 125 having the desired number of low dwell or dwells thereon and positioning the scale 155 (see FIG. 9) so that the number 157 thereon, viewable in the first opening 156 in the block 34, corresponds with the number on the cam 123 (see FIG. 6), the total number of the intermittent feed or feeds of the strip 55 (see FIG. 1) of material is determined.

It should be understood that the scale 155 (see FIG. 11) is held in the position to which it is moved through a leaf spring 163 supported by the block 34 and extending through an opening in the back wall of the block 34 to engage one of a plurality of flats 164 on the cylindrical shaped scale 155 with the number of the flats 164 being equal to the number of rows of the numbers 157 (see FIG. 9) and 160 on the scale 155. Setting of the pointer 162 by the adjusting screw 36 selects the length of the strip 55 (see FIG. 1) of material fed during each intermittent feeding even though the number 160 (see FIG. 9) on the scale 155 with which the pointer 162 cooperates is the total length of the strip 55 (see FIG. 1) of material fed prior to each cutting.

When it is desired to move the roller 56 away from the knurled roller 21 to manually feed the strip 55 of material therebetween at the start, it is necessary to push downwardly on a lever 165, which is pivotally mounted on a stud 166 fixed to the support 14. The lever 165 extends beneath the stud 57 and has a cut out portion 167 to accommodate the stud 57. When the lever 165 is moved downwardly, the lever 165 rotates counterclockwise about the stud 166 and has the upper surface of the cut out portion 167 engage the stud 57 to cause movement of the lever 60 (see FIG. 4) against the force of the spring 64 (see FIG. 3) whereby the roller 56 (see FIG. 1) is moved away from the knurled roller 21. Movement of the roller 56 is both outwardly and upwardly away from the knurled roller 21.

Considering the operation of the apparatus of the present invention, the strip 55 of material is passed over the roller 72, downwardly around the roller 75, upwardly over the roller 84, through the feed-in guide 86, between the roller 21 and the roller 56 through depressing the lever 165, and into the opening 87 (see FIG. 5) in the guide 88. The lever 165 (see FIG. 1) is released, and the drag arm 73 is disposed on top of the portion of the strip 55 of material passing over the roller 72.

To begin operation, the operator must close a switch (not shown), which is supported in a switch housing (not shown) within the cover (not shown) on top of the supports 14 and 15 in a manner similar to that in the aforesaid Schmidt et al patent, to supply AC power and a motor switch (not shown) in the switch housing (not shown) to energize the motor 41 (see FIG. 2). The motor 41 rotates the pulley 39 to drive the roller 21 (see FIG. 1) through the rack 28 (see FIG. 2) engaging the gear 27 of the gear housing 24 (see FIG. 10). During the first 180° of each revolution of the pulley 39 (see FIG. 2), the rack 28 moves downwardly, and the roller 21 (see FIG. 1) is rotated counterclockwise by the rack 28 (see FIG. 2) through the gear 27 and the one direction clutches 26 (see FIG. 10).

The connection between the pulley 39 (see FIG. 2) and the rack 28 produces an acceleration of the rack 28 during its initial downward movement and a deceleration as the rack 28 completes its downward movement. Thus, the speed of rotation of the roller 21 (see FIG. 1) is decreased as the feed of the strip 55 of material nears completion so that each selected length, intermittently fed by the roller 21, is the same length. Thus, when the same number of intermittent feedings of the strip 55 of material occurs prior to each cutting by the cutting blades 92 (see FIG. 5) and 93, then each of the cut lengths of the strip 55 of material is the same.

If the cam 123 (see FIG. 6), which is being driven by the ratchet 130, is replaced by the cam 136B (see FIG. 12) so that the low dwells are spaced other than equally angularly, as previously discussed, then the total length of the strip 55 (see FIG. 5) of material cut by the cutting blades 92 and 93 may vary in a sequential pattern. However, the strip 55 of material will be intermittently fed the same length during each cycle of operation.

After completion of 180° of revolution of the pulley 39 (see FIG. 2), the rack 28 begins to move upwardly. In the next 90° of revolution of the pulley 39 during which upward movement of the rack 28 occurs, the movable cutting blade 93 (see FIG. 5) can be moved into engagement with the stationary cutting blade 92 to cut the strip 55 of material which has been fed past the cutting blades 92 and 93 during the first 180° of the revolution of the pulley 39 (see FIG. 2). There is no feeding of the strip 55 (see FIG. 1) of material during the second 180° of revolution of the pulley 39 (see FIG. 2) because the rack 28 is moving upwardly.

However, the cutting blade 93 (see FIG. 5) is moved into engagement with the cutting blade 92 only if the roller 122 (see FIG. 6) on the arm 180 engages the low dwell on the profile 125 of the cam 123 during the first 180° of revolution of the pulley 39 (see FIG. 2). If this occurs, the finger 104 (see FIG. 6) on the arm 94 is positioned to be engaged by the bottom wall 126 of the recess 111 in the block 112 on the arm 113. However, if no low dwell on the profile 125 of the cam 123 engages the roller 122 during the first 180° of revolution of the pulley 39 (see FIG. 2), then the finger 104 (see FIG. 6) passes through the passage 119 in the block 112 and the arm 94 is not pivoted.

The cutting of the strip 55 (see FIG. 1) of material occurs during the first 90° of revolution of the pulley 39 (see FIG. 2) after the first 180° of revolution of the pulley 39. Thus, cutting, if it is to occur, is completed after 270° of the revolution of the pulley 39 for a particular cycle of operation (This comprises a revolution of the pulley 39.).

Figure 13:
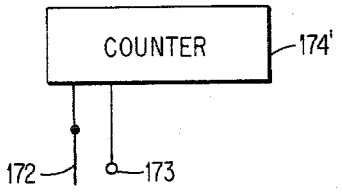
FIG. 13 is a schematic diagram showing a counter for counting the cutting cycles.

When the arm 94 (see FIG. 6) pivots about the pivot pin 95 to cause the cutting blade 93 (see FIG. 5) to move relative to the cutting blade 92 to cut the strip 55 (see FIG. 1) of material, a roller 170 (see FIG. 6), which functions as a cam follower, rides on an end cam surface 171 of the arm 94 to enable contacts 172 and 173 of a switch 174 to close. This produces a signal to a counter 174' (see FIG. 13) within the switch housing (not shown) to count each time that there is cutting of the strip 55 (see FIG. 1) of material. The counter 174' (see FIG. 13) can be set to stop cutting after any selected count.

The roller 170 (see FIG. 6) is mounted on an arm 175, which is pivotally mounted on a stud 176 carried by a block 176', which supports the switch 174 and is supported on the plate 91. When the arm 94 is in the position of FIG. 6 in which the arm 94 is in its inactive position, the arm 175 holds a resiliently biased switch arm 177, which carries the contact 172, against the force of a spring 178 so that the contacts 172 and 173 are held open. Thus, each cycle in which there is cutting of the strip 55 (see FIG. 1) of material, irrespective of the length of the cut and the number of intermittent feedings of the strip 55 of material prior to cutting, is counted by the counter 174' (see FIG. 13). This counting by the counter 174' (see FIG. 13) occurs during the cutting action of the cutting blades 92 (see FIG. 5) and 93 and near the completion of the cutting action.

The apparatus of the present invention functions automatically to continue to intermittently feed the strip 55 of material past the cutting position and cut the strip 55 of material after it has been advanced the total desired length. If the strip 55 of material should be held in the supply source so as not to be capable of being pulled therefrom, then the roller 75 (see FIG. 1) would move upwardly along the guide bar 77 until the switch 81 is opened. When this occurs, the motor 41 (see FIG. 2) is inactivated so that rotation of the pulley 39 is stopped. This prevents any further operation until the roller 75 (see FIG. 1) returns to the position in which the switch 83C is closed.

When the relatively long length of material is to be cut, its length can be checked to ascertain if it has been correctly selected at a portion (one sixteenth or one-eighth, for example) of its final length. This is accomplished by removing the cam 123 (see FIG. 6), for example, and allowing cutting of the strip 55 (see FIG. 1) of material after a single advancement of the ratchet 130 (see FIG. 6) by the pawl 135.

It should be understood that the amount of rotation of the cam 123 or 136B (see FIG. 12) by each advancement of the ratchet 130 (see FIG. 6) could be changed through using gearing means between the ratchet 130 and the cam 123 or 136B (see FIG. 12) or through changing the number of the teeth 134 (see FIG. 6). Thus, the rotation of the cam 123 or 136B (see FIG. 12) is not limited to $22\frac{1}{2}°$ during each advancement of the ratchet 130 (see FIG. 6).

An advantage of this invention is that it cuts any selected length of a strip of material within a range. Another advantage of this invention is that different lengths of a strip of material may be cut in a sequential pattern. A further advantage of this invention is that it reduces the waste of long lengths of material due to being too short.

For purposes of exemplification, a particular embodiment of the invention has been shown and described according to the best present understanding thereof. However, it will be apparent that changes and modifications in the arrangement and construction of the parts thereof may be resorted to without departing from the scope of the invention.

I claim:

1. An apparatus for cutting a strip of material into segments including:

a single drive means;

feed means to intermittently feed a selected length of the strip of material past a cutting position during each activation of said feed means;

first means to cause said single drive means to activate said feed means during a portion of each cycle of said single drive means;

cutting means to cut the fed material at the cutting position while said feed means is inactive;

and enabling means to enable said single drive means to activate said cutting means while said feed means is inactive to cut the fed material at the cutting position only after a selected number, greater than one, of the selected length of the strip of material has been intermittently fed past the cutting position by said feed means during more than one activation of said feed means.

2. The apparatus according to claim 1 including cam means to vary the selected number of the selected length of the strip of material after which said enabling means enables said single drive means to activate said cutting means.

3. The apparatus according to claim 2 including means to vary the selected length fed by said feed means during each intermittent feeding.

4. The apparatus according to claim 3 in which:

said feed means feeds the strip of material past the cutting position in a vertical direction;

and said cutting means is disposed beneath said feed means.

5. The apparatus according to claim 4 including means to change the selected number of the selected length of the strip of material in a sequential pattern.

6. The apparatus according to claim 4 including counting means to count only during each cutting action of said cutting means.

7. The apparatus according to claim 1 including means to change the selected number of the selected length of the strip of material in a sequential pattern.

8. An apparatus for cutting a strip of material into segments including:

feed means to feed a selected length of the strip of material past a cutting position during a first portion of each cycle of operation;

cutting means to cut the fed material at the cutting position during a second portion of a cycle of operation while said feed means is inactive;

means to control said cutting means to enable said cutting means to cut the fed material during a second portion of a cycle of operation while said feed means is inactive only after a selected number, greater than one, of the selected length of the strip of material has been fed past the cutting position by said feed means during a plurality of cycles of operation;

and said control means including:

first means movable from a first position to a second position during the first portion of a cycle of operation when said cutting means is to be activated during the second portion of the cycle of operation;

and second means movable into engagement with said first means during the second portion of the cycle of operation when said first means has been moved to the second position during the first portion of the cycle of operation, said second means engaging said first means to cause said cutting means to cut the fed material.

9. The apparatus according to claim 8 in which said first means of said control means includes:

actuating means to actuate said cutting means when said actuating means is engaged by said second means to cause said cutting means to cut the fed material when said first means of said control means is in the second position.

10. The apparatus according to claim 8 in which said first means of said control means includes:

holding means to hold said actuating means out of position for engagement by said second means of said control means until the selected number of the selected length of the strip of material has been fed past the cutting position by said feed means during a plurality of cycles of operation.

11. The apparatus according to claim 10 in which said holding means includes:

means engaging said actuating means to hold said actuating means;

and means cooperating with said engaging means to cause movement of said engaging means to a position in which said actuating means can be engaged by said second means of said control means after the selected number of the selected length of the strip of material has been fed past the cutting position during a plurality of cycles of operation.

12. An apparatus for cutting a strip of material into segments including:

feed means to feed a selected length of the strip of material past a cutting position during a first portion of each cycle of operation;

cutting means to cut the fed material at the cutting position during a second portion of a cycle of operation while said feed means is inactive;

means to control said cutting means to enable said cutting means to cut the fed material during a second portion of a cycle of operation while said feed means is inactive only after a selected number, greater than one, of the selected length of the strip of material has been fed past the cutting position by said feed means during a plurality of cycles of operation;

said control means including:

first means movable from a first position to a second position during the first portion of a cycle of operation when said cutting means is to be activated during the second portion of the cycle of operation;

and second means movable into engagement with said first means during the second portion of the cycle of operation when said first means has been moved to the second position during the first portion of the cycle of operation, said second means engaging said first means to cause said cutting means to cut the fed material;

said first means of said control means including actuating means to actuate said cutting means when said actuating means is engaged by said second means of said control means to cause said cutting means to cut the fed material when said first means of said control means is in the second position;

holding means to hold said actuating means out of position for engagement by said second means of said control means until the selected number of the selected length of the strip of material haas been fed past the cutting position by said feed means during a plurality of cycles of operation;

said holding means including:

means engaging said actuating means to hold said actuating means;

and means cooperating with said engaging means to cause movement of said engaging means to a position in which said actuating means can be engaged by said second means of said control means after the selected number of the selected length of the strip of material has been fed past the cutting position during a plurality of cycles of operation;

and said cooperating means including:

cam means;

rotating means to rotate said cam means a predetermined angular amount during the first portion of each cycle of operation;

said engaging means having cam follower means thereon for engaging said cam means;

means to urge said cam follower means against said cam means;

said cam means having at least one low dwell on its profile;

and said urging means moving said engaging means when said cam follower means engages a low dwell on said cam means to a position in which said actuating means can be engaged by said second means of said control means during the second portion of the cycle of operation in which said cam follower means engages a low dwell on said cam means.

13. The apparatus according to claim 12 in which said rotating means includes:

a ratchet causing rotation of said cam means with said ratchet;

a driving pawl to cause rotation of said ratchet for a predetermined angular amount during each activation of said driving pawl;

a pivotally mounted arm cooperating with said driving pawl to activate said driving pawl;

and means to pivot said arm during the first portion of each cycle of operation to activate said driving pawl so that said driving pawl causes rotation of said ratchet the predetermined angular amount.

14. The apparatus according to claim 13 in which said second means of said control means includes:

a pivotally mounted arm for engaging said actuating means;

and means to pivot said arm during the second portion of each cycle of operation to cause movement of said actuating means when said actuating means is disposed for engagement by said last mentioned arm.

15. The apparatus according to claim 12 in which said cam means has a plurality of low dwells thereon.

16. The apparatus according to claim 12 in which said cam means has a plurality of equally angularly spaced low dwells thereon.

17. The apparatus according to claim 8 including means to count only during each cutting action of said cutting means.

* * * * *

UNITED STATES PATENT AND TRADEMARK OFFICE

CERTIFICATE OF CORRECTION

PATENT NO. : 4,280,384

DATED : July 28, 1981

INVENTOR(S) : Volker Schmidt

It is certified that error appears in the above—identified patent and that said Letters Patent is hereby corrected as shown below:

Column 13, line 21, "the" should read -- a --.

Column 15, line 53, "haas" should read -- has --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*